US006022250A

United States Patent [19]

Futaki et al.

[11] Patent Number: 6,022,250

[45] Date of Patent: Feb. 8, 2000

[54] WATERCRAFT WITH TWIN JET PROPULSION UNITS

[75] Inventors: Yoshiki Futaki; Satoshi Koyano, both of Shizuoka, Japan

[73] Assignee: Yamaha Hatsudoki Kabushiki Kaisha, Japan

[21] Appl. No.: 08/953,692

[22] Filed: Oct. 17, 1997

[30] Foreign Application Priority Data

Oct. 17, 1996 [JP] Japan ..... 8-297492

[51] Int. Cl.[7] ..... B63H 11/00

[52] U.S. Cl. ..... 440/38; 440/41; 440/42; 440/47

[58] Field of Search ..... 440/38, 40–43, 440/47; 114/270; 60/221, 222

[56] References Cited

U.S. PATENT DOCUMENTS

| | | | |
|---|---|---|---|
| 3,089,454 | 5/1963 | Chronic | 440/41 |
| 3,827,392 | 8/1974 | Jones | 114/270 |
| 3,982,497 | 9/1976 | Caron | 114/270 |
| 4,276,035 | 6/1981 | Kobayashi . | |
| 5,145,426 | 9/1992 | Kobayashi et al. . | |
| 5,401,198 | 3/1995 | Toyohara et al. . | |
| 5,449,305 | 9/1995 | Kobayashi et al. . | |
| 5,494,464 | 2/1996 | Kobayashi et al. . | |
| 5,839,927 | 11/1998 | Thomas et al. | 440/43 |

FOREIGN PATENT DOCUMENTS 5-229484 7/1993 Japan .

*Primary Examiner*—Sherman Basinger
*Attorney, Agent, or Firm*—Knobbe, Martens, Olson & Bear LLP

[57] ABSTRACT

An improved mounting arrangement for a twin jet propulsion unit eases the assembly of the system, as well as enhances the performance of the system. A unified mounting plate supports the propulsion units and offer a degree of adjustability which permits the propulsion units to be precisely aligned with desired longitudinal axes defined by the watercraft hull, as well as with each other. In addition, the rigidity provided by the mounting plates tends to hold the propulsion units, which cantilever rearward from the mounting plates, in the desired positions. As a result, additional support structure and fasteners can be removed from between the jet propulsion units and they can be spaced closer together so as to generally match a desired spacing between the inlet openings of the associated intake ducts.

29 Claims, 10 Drawing Sheets

WATERCRAFT WITH TWIN JET PROPULSION UNITS

BACKGROUND OF THE INVENTION

1. Field of the Invention

The present invention relates in general to a propulsion device for a watercraft, and in particular to a multiple-jet propulsion device.

2. Description of Related Art

Many watercraft now employ inboard-mounted jet propulsion units due to several distinct advantages over propeller type propulsion systems. For instance, no open propeller poses a hazard with a jet propulsion unit. The unit also does not detract from the watercraft's exterior appearance.

The thrust performance of a jet propulsion unit, however, is commonly limited because the impeller tends to cavitate when driven at a rotational speed above an upper limit. Cavitation reduces the efficiency of the impeller and thus the thrust performance of the jet propulsion unit.

Some prior watercraft have employed several jet propulsion units in order to fully utilize the power output by a high-horsepower engine. The large engine thus drives multiple jet propulsion units, but at a rotational speed that does not cause meaningful cavitation. That is, the engine drives each jet propulsion unit at a rotational speed below the designed upper limit and, thus, cavitation does not occur to such a degree that the efficiency of the jet propulsion unit suffers. The propulsion system thus can provide more thrust without losing efficiency.

Several prior watercraft designs, which employ multiple jet propulsion units, have located the units in a side-by-side arrangement, behind a pair of centrally disposed, juxtaposed water inlets which are located on the underside of the watercraft hull. The use of water inlets, which are arranged as close to the center line of the watercraft as possible, reduces the tendency of the jet propulsion units to draw in air when the watercraft turns. These openings, as well as at least a portion of the associated inlet ducts directly behind the openings, commonly are integrally formed with the watercraft hull.

Despite the desire to position the inlet openings closely together, prior watercraft have not done the same with the impeller housings, which receive water from the inlet ducts. One reason for this is that the impeller housings are secured to the hull by fasteners. This arrangement requires space for the fasteners, and the impeller housings cannot be as closely positioned together as are the inlet openings.

In addition, prior impeller housings have been sufficiently spaced apart to accommodate water supply and drain hoses. The water supply hose connects to impeller housing at a point downstream of the impeller and receives pressurized water through a water tap. The hose extends along the side of the impeller housing and into the hull wherein it is connected to a water jacket of the engine. Similarly, the drainage hose is connected to the impeller housing at a point upstream of the impeller and extends into the hull along side the impeller housing. The drainage hose extends into a bilge of the hull for removing water therefrom. As a result, the spacing between the impeller housings has been greater than the spacing between the inlet openings on prior watercraft in order to accommodate the hoses.

Each inlet duct thus must bend outward, away from the center line of the watercraft, in order to align with the mouth of the associated impeller housing. The resulting curvilinear path through the inlet duct increases the resistance (i.e., drag) of water flow through inlet duct, thereby decreasing the efficiency of the propulsion unit.

The pump housings are also usually affixed to an upstanding wall of the hull. The wall, however, does not provide a rigid support on which to mount the pump housings. Flexure of the wall is not uncommon. Misalignment (i.e., non-parallelism) between the jet pump units occurs which results in power loss because the thrust of the jet pump units are not oriented to optimize propulsion efficiency. For instance, a downward orientation of the jet pump units causes a portion of the produced thrust to rise the aft end of the watercraft rather that propel the watercraft forward.

SUMMARY OF THE INVENTION

The invention is adapted to be embodied in a jet propulsion system in which the configuration of the intake inhibits undesirable water flow characteristics upstream of the jet propulsion units. The thrust performance of the units consequently improves over prior multi-jet propulsion designs.

One aspect of the present invention thus involves a watercraft comprising a propulsion system. The propulsion system includes a pair of jet propulsion units and a pair of longitudinally extending intake ducts that communicate with the jet propulsion units. A hull of the watercraft includes a pair of generally parallel tunnels which are formed on an underside of the hull, and integral therewith. Each tunnel forms at least a portion of one of the intake ducts. Unified plates are provided between each intake duct and the corresponding jet propulsion unit. The unified plates are joined together and are supported by the hull with the jet propulsion units mounted to the plates. Each plate includes an opening which places the attached jet propulsion unit in communication with the corresponding intake duct.

Further aspects, features, and advantages of the present invention will become apparent from the detailed description of the preferred embodiments which follows.

BRIEF DESCRIPTION OF THE DRAWINGS

The above-mentioned and other features of the invention will now be described with reference to the drawings of preferred embodiments of the present watercraft. The illustrated embodiments are intended to illustrate, but not to limit the invention. The drawings contain the following figures.

DETAILED DESCRIPTION OF THE PREFERRED EMBODIMENT

Figure 1:
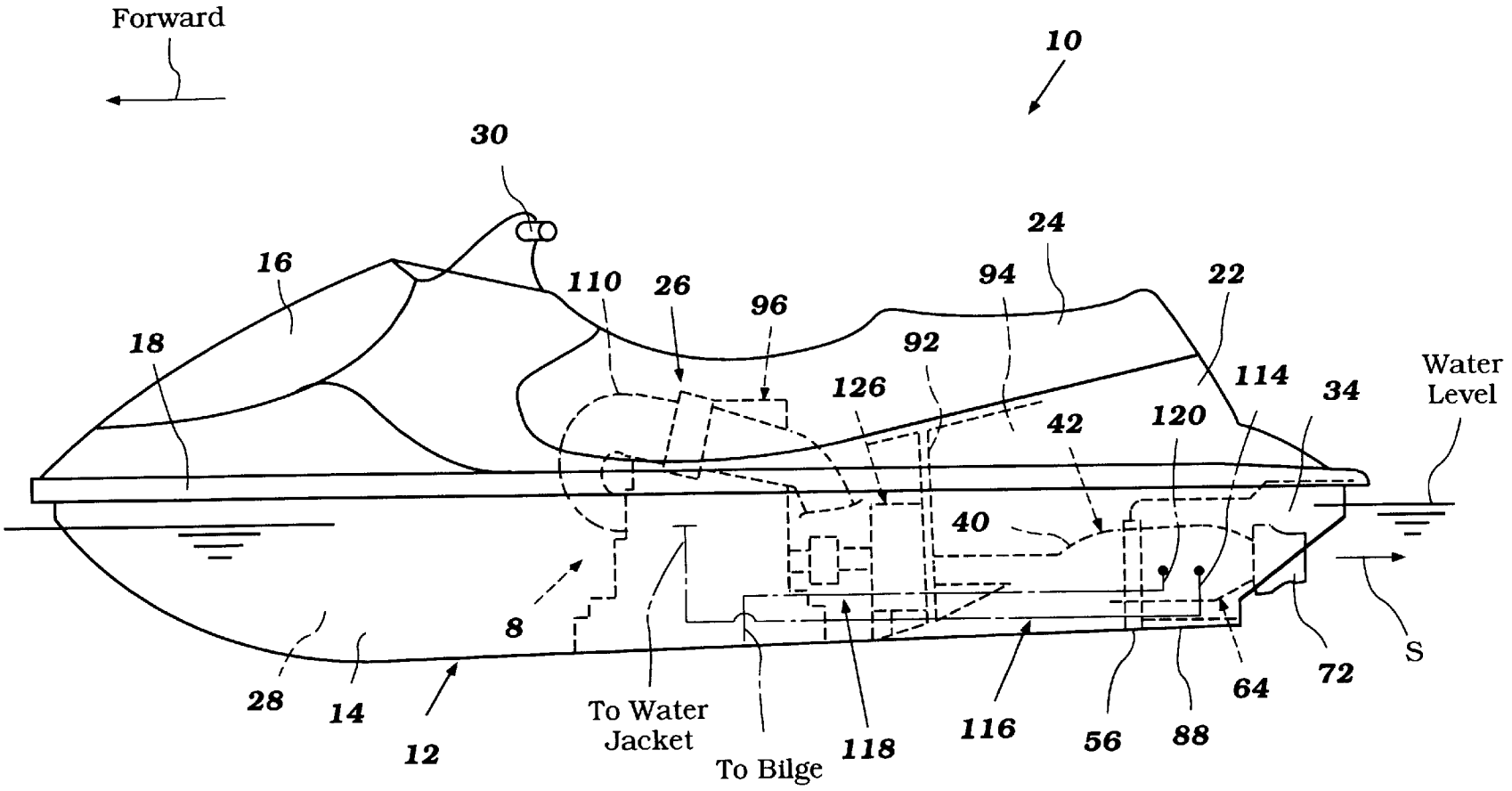
FIG. 1 is a side elevational view of a watercraft powered by a twin jet propulsion unit which is configured in accordance with a preferred embodiment of the present invention, and illustrates several internal components of the watercraft in phantom.

The present propulsion system 8 has particular utility for use with personal watercraft, and thus, the following describes the propulsion system in the context of a personal watercraft. This environment of use, however, is merely exemplary. The present propulsion system can be readily adapted by those skilled in the art for use with other types of watercraft a well, such as, for example, but without limitation, small jet boats and the like.

With initial reference to FIGS. 1 through 9, the watercraft 10 includes a hull 12 that is formed by a lower hull section 14 and an upper deck section 16. The hull sections 14, 16 are formed of a suitable material such as, for example, a molded fiberglass reinforced resin, and can be made by any of a wide variety of methods. For instance, the deck 16 and the hull 14 can each be formed using a sheet molding compound (SMC), i.e., a mixed mass of reinforced fiber and thermal setting resin, that is processed in a pressurized, closed mold. The lower hull section 14 and the upper deck section 16 are fixed together around their peripheral edges in any suitable manner. For instance, the peripheral flanges of the upper deck section 16 and the lower hull section 14 can nest and be bonded together.

The upper deck section 16 and the lower hull portion 14 together define a pair of raised gunnels 18 positioned on opposite sides of the aft end of the upper deck assembly 16. The raised gunnels define a pair of foot areas that generally extend longitudinally and parallel to the sides of the watercraft 10. In this position, the operator and any passenger sitting on the watercraft 10 can place their feet in the foot areas with the raised gunnels 18 shielding the feet and lower legs of the riders. A non-stick (e.g., rubber) mat desirably covers the foot areas to provide increased grip and traction for the operator and the passengers.

Toward the aft end of the watercraft 10, a seat pedestal 22 rises above the foot areas. The pedestal 22 supports a seat cushion 24 to form a seat assembly 26. In the illustrated embodiment, the seat assembly 26 has a longitudinally extending, straddle-type shape which may be straddled by an operator and by at least one or two passengers. For this purpose, the raised pedestal 22 has an elongated shape and extends longitudinally generally along a center line of the watercraft 10. The seat cushion 24 is removably attached to the pedestal 22 by a quick-release latching assembly, as known in the art. An access opening (not shown) is formed (at least in part) beneath the seat cushion 24 to provide access into an engine compartment 28 formed within the hull 12.

A control mast is formed just forward of the seat assembly 26. The control mast includes a steering column that supports a steering operator 30. In an illustrated embodiment, the steering operator 30 is a handlebar assembly; however, other steering operators, such as, for example, a steering wheel or a control stick (i.e., joystick), also can be used. The steering column operates a steering actuator (not shown). The actuator affects steering movement of the watercraft 10 in the manner described below.

Figure 4:
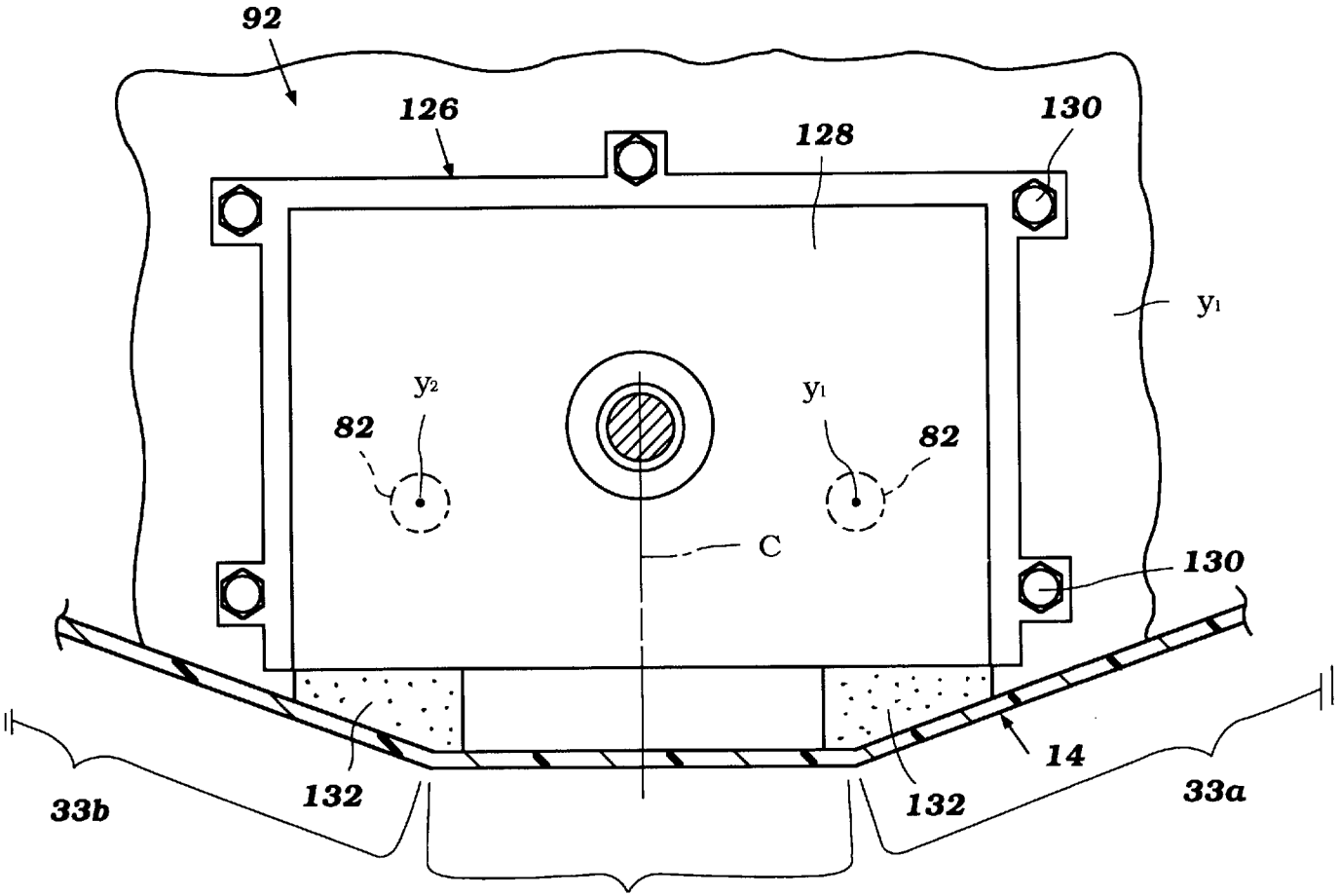
FIG. 4 is a partial sectional view taken along line 4—4 of FIG. 3.

As best understood from FIG. 4, the lower hull is designed such that the watercraft 10 planes or rides on a minimum surface area at the aft end of the hull when up on plane in order to optimize the speed and handling of the watercraft 10. For this purpose, in the illustrated embodiment, the lower hull section 14 generally has a V-shape which includes a generally straight horizontally extending keel 32. Incline sections 33*a*, 33*b* extend between the keel and the sides of the watercraft, which form a portion of the raised gunnels 18. These incline sections 33*a*, 33*b* can be configured to include one or more chines and/or one or more stakes, and can be formed by a plurality of sections of differing dead rise angles.

Figure 6:
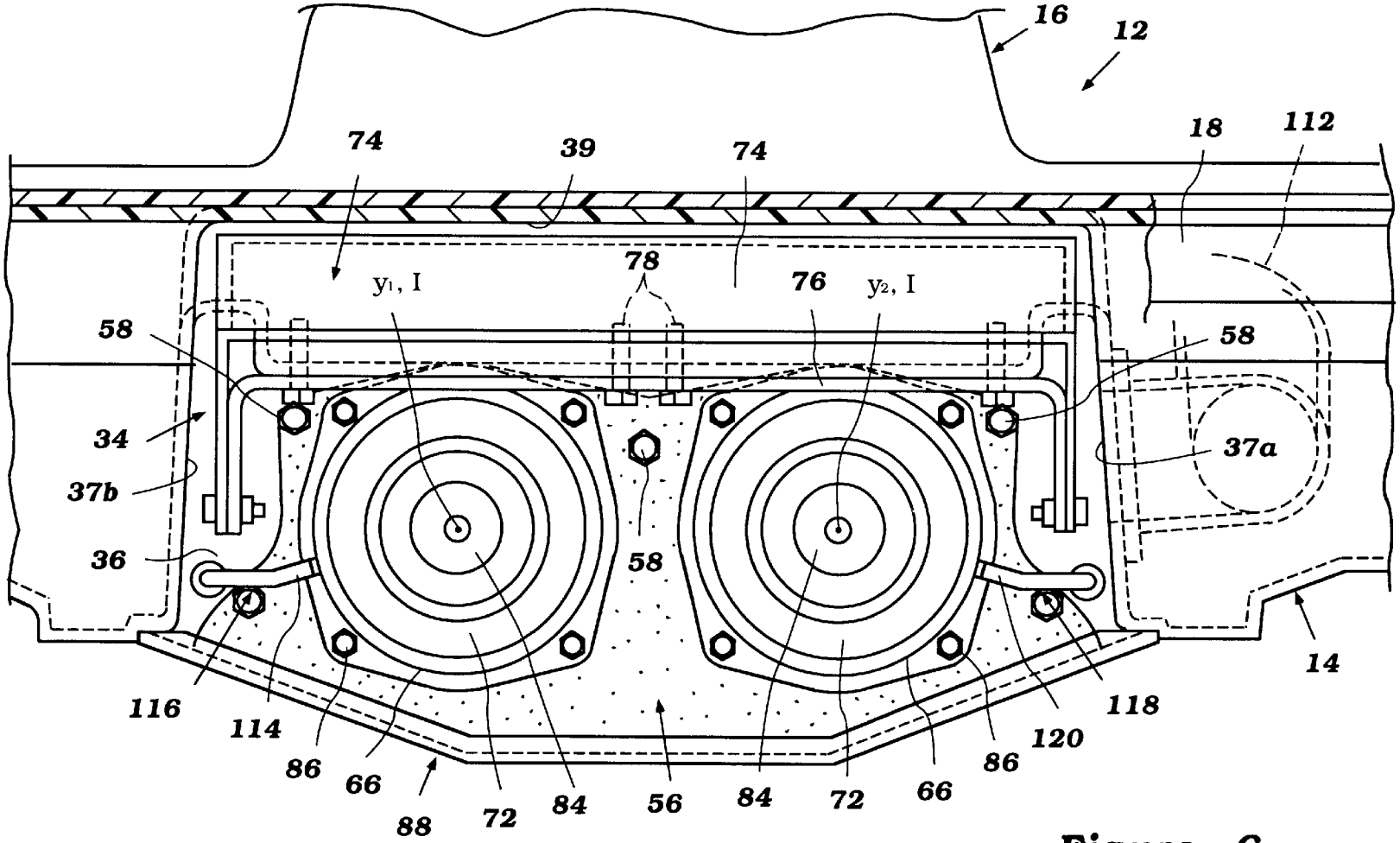
FIG. 6 is an enlarged, partial sectional, rear side view of the jet propulsion system of FIG. 2.

Towards a transom of the watercraft 10, the lower hull section 14 includes an upwardly extending pump chamber 34. The pump chamber 34 has a generally parallelpiped shape and opens through the rear of the transom, as understood from FIG. 1, and is symmetrically positioned about a central plane C of the watercraft. The pump chamber 34 terminates at its front end in a front wall 36. The chamber 34 also is defined by a pair of side walls 37*a*, 37*b*, and an upper wall 39, as best seen in FIG. 6.

Figure 2:
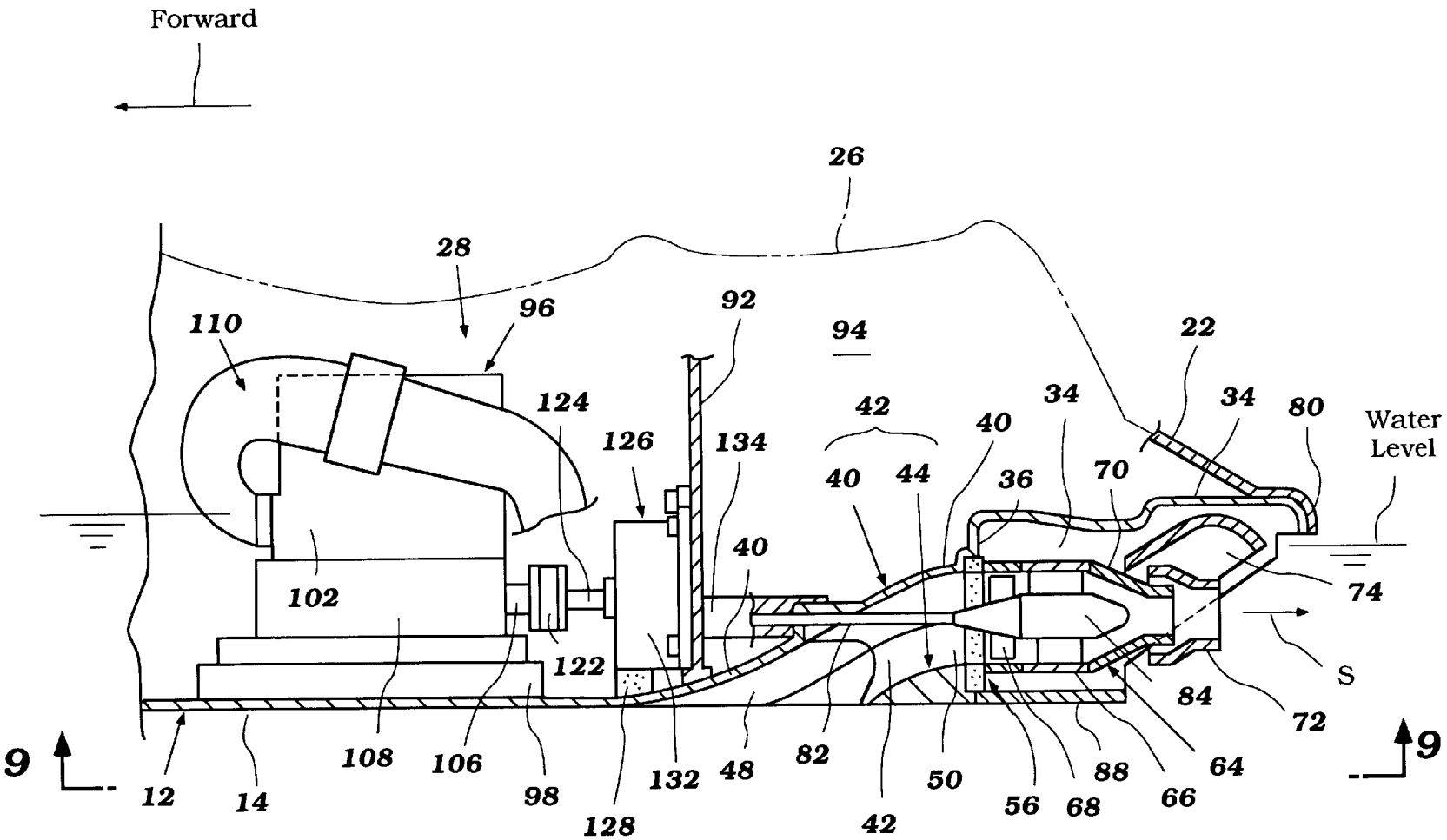
FIG. 2 is an enlarged, partial sectional side view of the watercraft of FIG. 1 illustrating an engine and the twin jet propulsion system.
Figure 7:
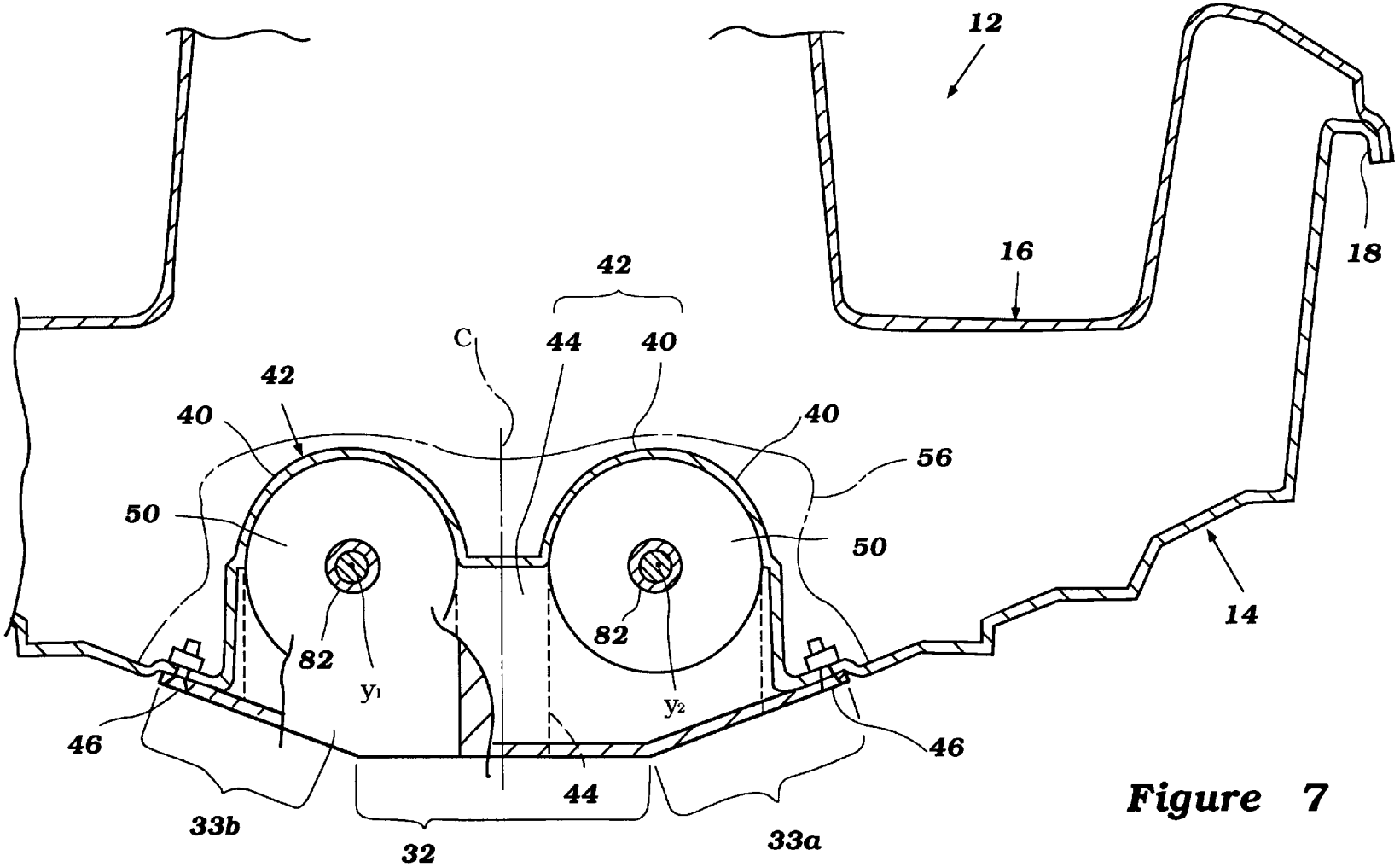
FIG. 7 is an enlarged, sectional view of a pair of intake ducts of the jet propulsion system taken along line 7—7 of FIG. 5.
Figure 8:
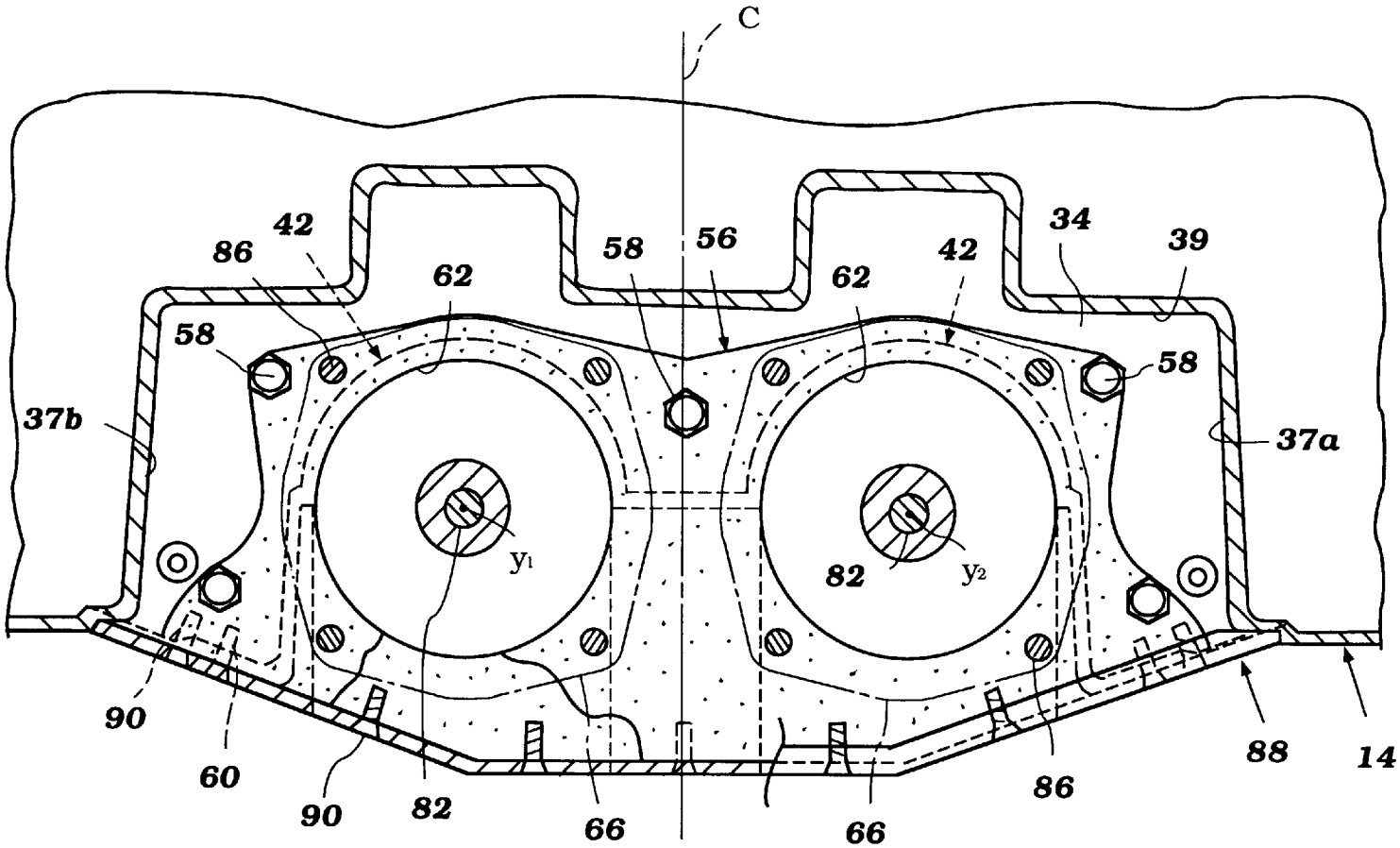
FIG. 8 is an enlarged, sectional rear view of the jet propulsion system taken along line 8—8 of FIG. 5.

As best understood from FIGS. 2 and 7, the hull lower section 14 also defines a pair of generally parallel, tunnels-like sections 40. Each tunnel 40 is formed by an upper wall and an outer side wall. Inner side walls of the tunnels 40 extend downward for only a portion of the height of the outer side walls and are joined together by a bridge section. This gives the combined tunnel structure, which is formed on the underside of the hull 14, a generally M-like shape, as best seen in FIG. 7. This structure is desirably symmetrically positioned about the watercraft's central plane C.

As understood from FIG. 2, the upper surfaces of the tunnels 40 sweep upwardly from generally the level of the keel 32 and rise to a point above the keel line. The side walls of each tunnel 40 follow this path. Both the upper surface and the side surfaces of each tunnel 40 extend rearward and terminate at the front wall 36 of the pump chamber 34. The propulsion system 8 includes a pair of water intake ducts 42. The ducts 42 are formed in part by the dual tunnel structure. In the illustrated embodiment, the tunnels 40 form the upper halves of the intake ducts 42.

The lower halves of the intake ducts 42 are formed by a lower insert plate 44. The insert plate 44 closes the lower end of the dual tunnel structure as well as divides the tunnels 40. The insert plate 44 also includes a pair of grooves. Each groove mates with a corresponding upper tunnel section to define a water passage through the intake duct 42 that has a generally circular cross-sectional shape.

The underside of the plate 44 includes a generally flat central section and a pair of inclined sections. The width of the central section generally matches that of the hull's keel 32, and the inclined sections extends from the outer edges of the central section at a dead rise angle that generally matches that of the hull 14, proximate to the keel 32. Fasteners 46 secure the insert plate 44 onto the underside of the hull.

The intake ducts 42, as defined by the tunnel sections 40 and the insert plate 44, extend longitudinally in a direction generally parallel to the watercraft central plane C. The is, the distances between the axes of the intake ducts 42 and the central plane remain substantially constant along the length of the ducts 42. As a result, the ducts 42 have a generally straight flow path in the fore-to-aft direction.

Figure 9:
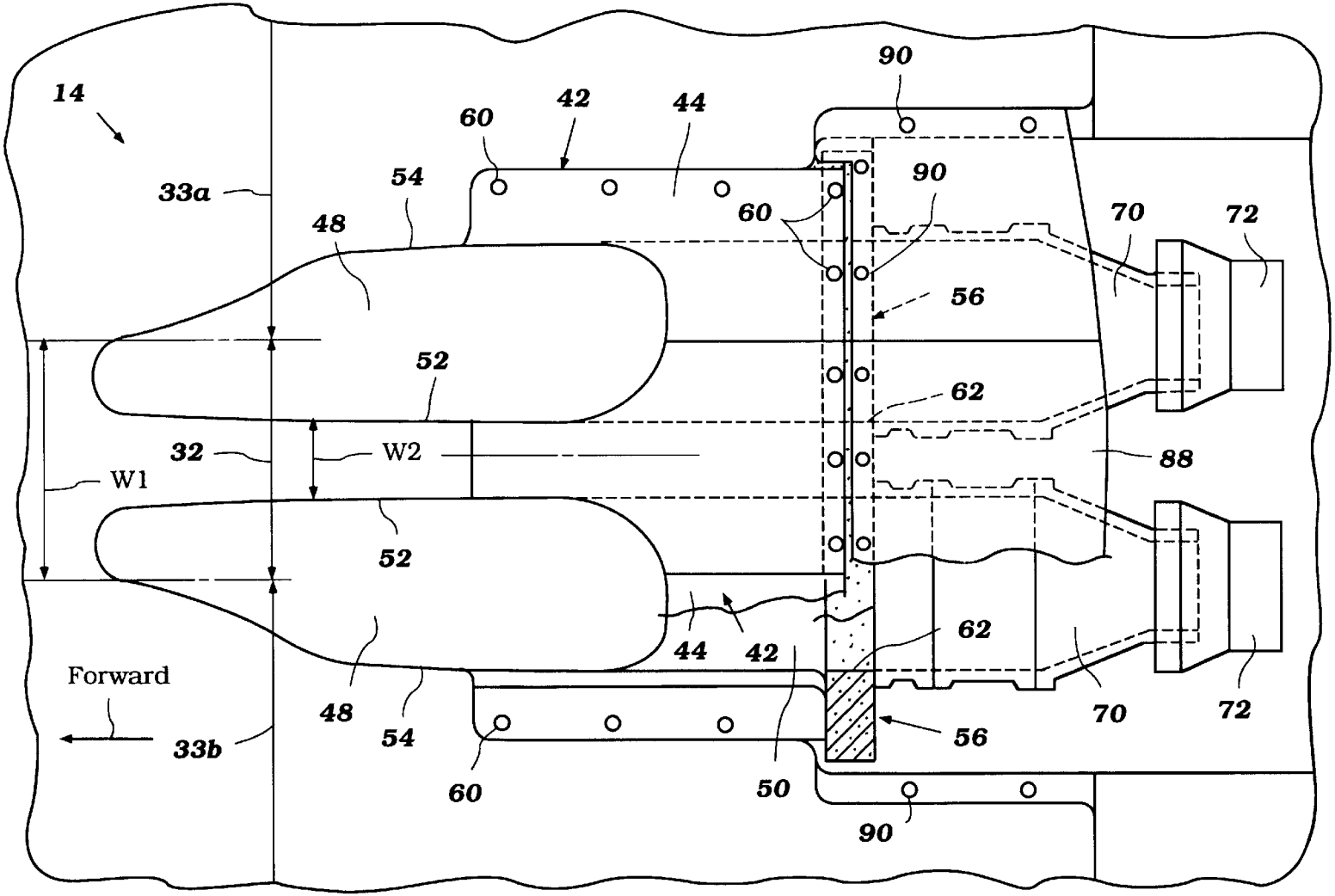
FIG. 9 is an enlarged, partial sectional, bottom plan view of the jet propulsion system of FIG. 2.

As seen in FIGS. 2, 7 and 9, each intake duct 42 extends between an inlet or influent opening 48 and an effluent opening 50 at the rear end of the duct 42. The influent opening 48 is defined by the hull 14 and the insert plate 44 and has a curvilinear shape. As best seen in FIG. 9, each influent opening 48 has an inner edge 52 which is generally straight along the entire length of the opening 48. An outer edge 54, however, flares outwardly at the front end of the opening 48, and then transitions into a generally straight portion toward the aft end of the influent opening 48. The outer edges 54 are formed on the incline sections 33*a*, 33*b* of the hull 14, and thus lie above the inner edges 52. The inner and outer edges 52, 54 of each opening 48 are generally parallel to each other near the opening's aft end. The influent opening 48 thus has a wider aft end than its fore end.

The influent openings 48 are arranged generally parallel to one another and are symmetrically positioned about the watercraft center plane C. Importantly, the inner edges 52 of the influent openings 48 lie on the flat surface defined by the keel 32 and the insert plate central section. For this purpose, the distance W2 between the inner edges 52 is less than the width W1 of the keel 32 (see FIG. 9). In the illustrated embodiment, the distance W2 between the inner edges 52 is less than half of the keel's width W1, and more preferably about a third of the keel's width W1. This arrangement of the influent openings 52 on the hull's underside helps maintain both openings 52 in contact with the body of water in which the watercraft 10 is operated even when the watercraft is aggressively leaning (i.e., when sharply turning).

The rear effluent openings 50 open through the front wall 36 and into the pump chamber 34. The openings 50 desirably have circular cross-sectional shapes and are defined about an axes Y1 and Y2. These axes y1, y2 are parallel to the flow axes through the intake ducts and to the central place C of the watercraft.

A unified mounting plate 56 is secured to the front wall just behind the effluent openings 50 of the intake ducts 42. As best seen in FIG. 6, a plurality of fasteners 58 secure the upper and side peripheries of the mounting plate 56 to the front wall 36 of the hull's pump chamber 34. This mounting plate 56 has a sufficient thickness to strengthen and add rigidity to the front wall 36. In the illustrated embodiment, the mounting plates 56 is formed of a properly coated and/or treated wood; however, any of a wide variety of materials, the suitability of which is well known to those skilled in the art, can be used as well.

The mounting plate 56 extends across the rearward opening formed by the tunnel sections. In the illustrated embodiment, the width of the mounting plate 56 is only slightly smaller than the width of the pump chamber 34, as defined between the side walls 37*a*, 37*b*. The mounting plate 56 also depends from a point on the front wall 36 above the tunnels 40 to a lower edge of the mounting plate 56. The lower edge lies just above to the insert plate 44 and includes a similar shape. That is, the lower edge has a generally flat central section and a pair of inclined outer sections. As best seen in FIG. 9, fasteners 60 secure the rear edge of the insert plate 44 to the lower edge of the mounting plate 56.

The mounting plate 56 includes openings 62 which connect the effluent openings 50 of the intake ducts 42 with the pump chamber 34. Each opening 62 in the mounting plate 56 desirably has a diameter that matches the diameter of the corresponding intake duct effluent port 50.

Figure 5:
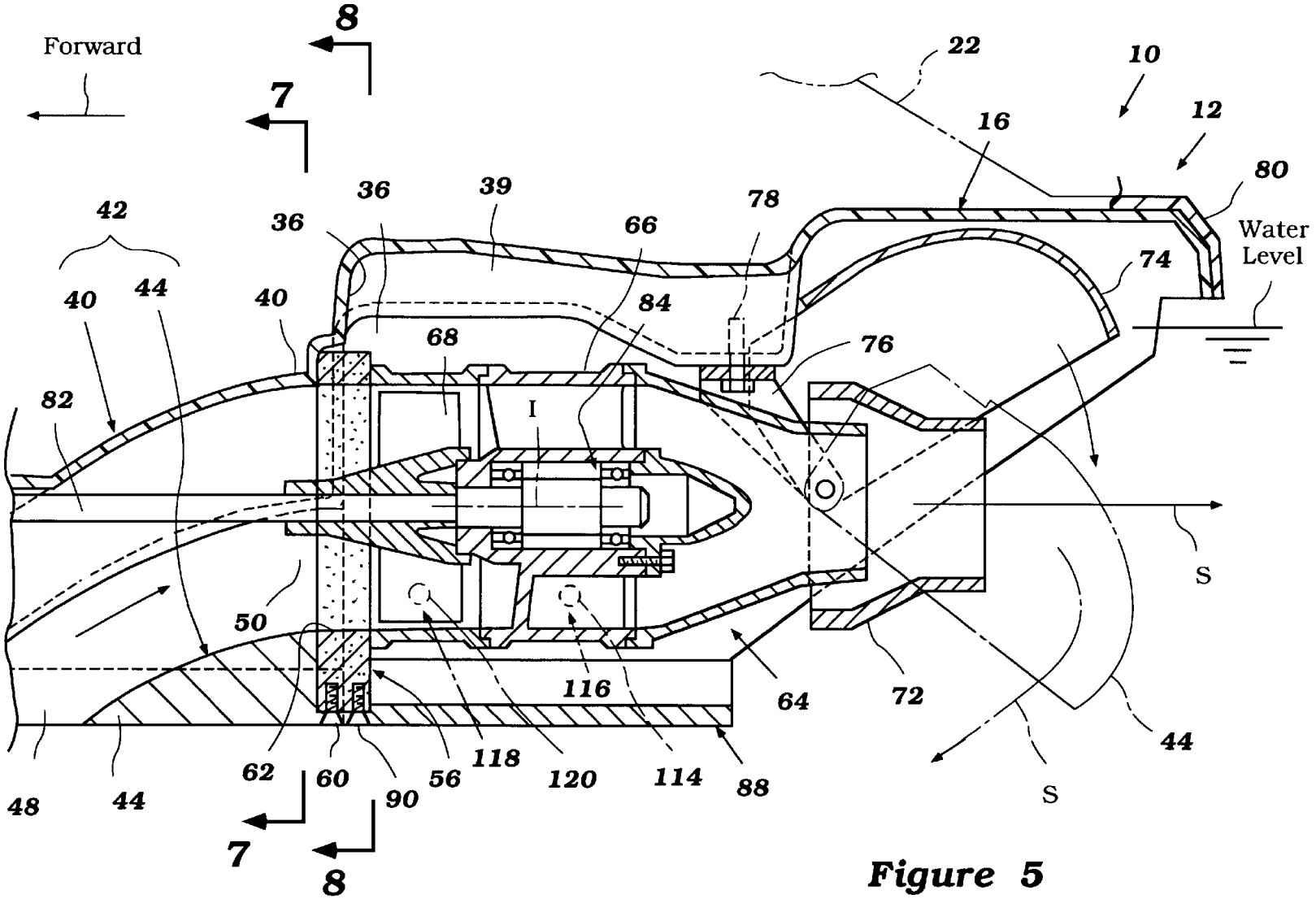
FIG. 5 is an enlarged, partial sectional side view of the jet propulsion system of FIG. 2.

The propulsion system also includes a pair of twin jet propulsion units 64. As best seen in FIGS. 2 and 5, each jet propulsion unit 64 includes an impeller housing 66 in which an impeller 68 of the jet propulsion unit 64 operates. The impeller housing 66 also acts as a pressurization chamber and delivers the water flow from the impeller to a discharge nozzle 70.

A steering nozzle 72 is supported at the downstream end of the discharge nozzle 70 by a pair of vertically extending pivot pins. In the exemplary embodiment, the steering nozzle 72 includes a lever on one side which is moved by the actuator (e.g., a bowden-wire cable) that is controlled by the steering operator 30. In this manner, steering movement is effected by movement of the operator 30. A propulsion stream of water exits the steering nozzle in a direction of discharge S to propel the watercraft 10.

Figure 3:
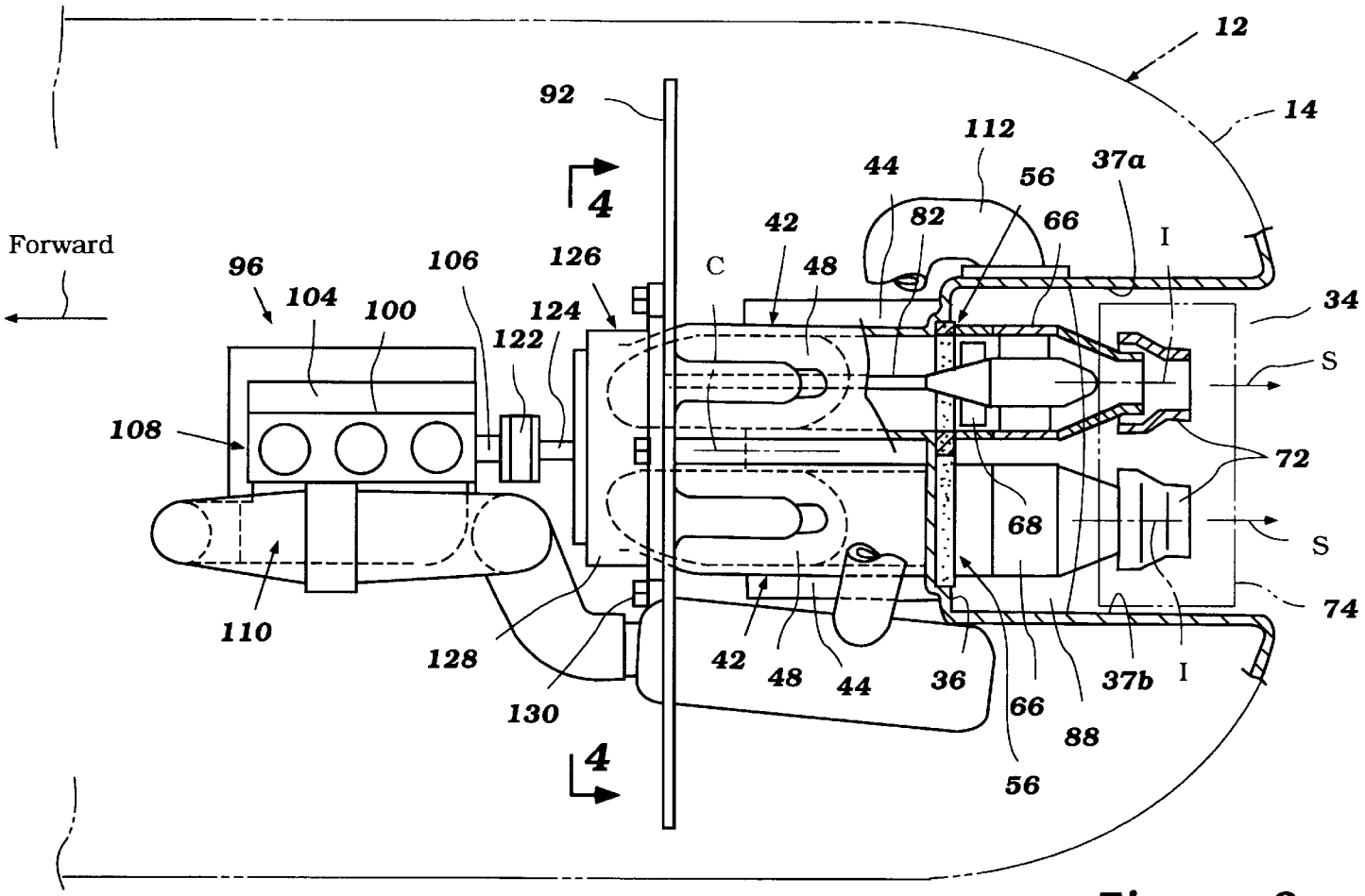
FIG. 3 is an enlarged, partial sectional top view of the engine and twin jet propulsion system of FIG. 2.

The watercraft 10 also includes a reverse thrust bucket 74 to reverse the direction of thrust of the propulsion system 8, as schematically illustrated in FIG. 5. The bucket 74 has a sufficient width to extend across the ends of the steering nozzles 72, as seen in FIGS. 3 and 6. An upper bracket 76 supports the reverse thrust bucket 74 in this position. Fasteners 78 attached the bracket 76 to the upper wall 39 of the pump chamber 34.

The bucket 76 is movable between a storage position and an employed position. In the storage position, the bucket 76 is positioned above the discharge nozzles 72 and just below a rear deck 80 (which forms a portion of the upper wall of the pump chamber). In the employed position, the bucket 76 covers the ends of the discharge nozzles 72 and redirects the jet streams in a generally forward direction. A remote operator (not shown), which is desirably positioned near the steering operator 30, actuates the reverse thrust bucket 76 through a conventional mechanism.

An impeller shaft 82 drives each impeller 68. The aft end of the impeller shaft is supported within the impeller housing 66 by a bearing assembly 84. The bearing assembly 84 suitably journals the impeller shaft 82 for rotation about its axis I. The axis I for each jet propulsion unit 64 desirably aligns with the central axis Y of the corresponding intake duct 42. In this manner, the impeller housing 66 and the rear effluent opening 50 of the intake duct 42 are aligned.

To achieve this alignment, the jet propulsion units 64 are mounted to the mounting plate 56. The mounting plate 56, whose position can be varied relative to the hull (e.g., by shims), is used to adjust the position of the jet propulsion units 64 relative to the intake ducts 42 and to the hull 14. Fasteners 86 (FIG. 6) secure each jet propulsion unit 64 to the mounting plate 56 with the mouths of the impeller housing 66 placed over and concentrically aligned with the corresponding opening 62 in the mounting plate 56.

The increased rigidity provided by the mounting plate 56 also permits the jet propulsion units 64 to extend in generally a cantilever fashion without deflecting the front wall 36. As a result, the jet propulsion units 64, as well as the impeller shafts 82, can be held parallel to one another and aligned with the keel 32 in order to optimize the efficiency of the thrust provided by the propulsion system 8.

A ride plate 88 closes at least a portion of the pump chamber's lower side at a located behind the insert plate 44. The ride plate 88 thus encloses the jet propulsion units 64 within the pump chamber 34. In this manner, the lower opening of the chamber 34 is closed to provide in part a planing surface for the watercraft 10. The ride plate 88 desirably includes a generally straight, horizontally extending central section which is at least parallel to the keel 32 of the hull lower section 14. In the illustrated embodiment, the ride plate 88 also includes inclined side sections that extend at generally the same dead rise angle as the portion 33*a*, 33*b* of the hull 14 about the ride plate 88. Fasteners 90 secure the side edges of the ride plate 88 to the underside of the hull 14 and the front edge of the ride plate 88 to the mounting plate 56. The front edge of the ride plate 88 desirably lies just behind the rear edge of the insert plate 44.

Forward of the mounting plate 56, each impeller shaft 82 extends through the corresponding intake duct 42 and through a cylindrical casing that is integrally formed with the intake duct 42 as part of the hull 14. The impeller shaft 82 thence extends through a bulkhead 92 formed at the rear end of the engine compartment 28.

The bulkhead 92 desirably divides the hull 14 into front and rear compartments. The front compartment functions as the engine compartment 28, while the rear compartment 94 is formed above the tunnel sections 40 and the pump chamber 34.

The lower hull portion 14 principally defines the engine compartment 28 forward of the bulkhead 92. Except for a conventional ventilation system, which includes a plurality of air ducts, the engine compartment 28 is normally sealed so as to enclose an engine 96 and a fuel system of the watercraft 10 from the body of water in which the watercraft 10 is operated.

The internal combustion engine 96 drives the impeller shaft 82 to power the jet propulsion unit 64. The engine 96 is positioned within the engine compartment 28 and is mounted centrally within the hull 12. A vibration-absorbing engine mounts 98 secures the engine 96 to the lower hull section 14.

In the illustrated embodiment, the engine 9i operates on a four stroke principle and includes three in-line cylinders 100. The engine 96 is positioned such that the row of cylinders 100 lies parallel to the watercraft's central plane C. Those skilled in the art, however, will really appreciate that the present propulsion system 8 can be used with any of a variety of engine types having other numbers of cylinders, having other cylinder arrangements, and operating on other combustion principals.

A cylinders block 102 and a cylinder head assembly 104 desirably form the cylinder 100 of the engine 96. A piston (not shown) reciprocates in each cylinder 100. The pistons together drive a crankshaft 106, in a known manner. The crankshaft 106 is desirably journaled within a crankcase 108, which in the illustrated embodiment, is formed between a crankcase member and lower end of the cylinder block 102. A connecting rod links the corresponding piston to the crankshaft 106. The corresponding cylinder bore, piston and cylinder head of each cylinder 100 form a variable-volume chamber, which at minimum volume defines a combustion chamber.

An induction system 108 delivers an fuel/air charge to the cylinders 100. In the illustrated embodiment, the induction system 108 includes an intake air silencer which lies above the engine 96. The silencer supplies air to at least one charge former (e.g., a carburetor). The engine 96 desirably includes a number of charge formers equal to the number of cylinders, and the charge formers are floatless-type carburetors; however, it is understood that other types of charge formers, such as, for example, fuel injectors also can be used with the engine 96.

An exhaust manifold is attached to the opposite side of the cylinder block 102 and communicates with exhaust discharge ports associated with each cylinder 100. The exhaust manifold delivers exhaust byproducts to an exhaust system 110 for discharge.

The exhaust system 110 includes a C-shaped pipe that is attached to the exhaust manifold. The C-pipe delivers exhaust gases from the exhaust manifold to an expansion chamber located above and to the side of the engine 96. The expansion chamber lies on a side of the engine block 102.

The exhaust system desirably includes a flexible pipe that connects the expansion chamber to a water trap device. Both the water trap device and the flexible pipe are disposed along one side of the watercraft hull tunnels 40.

An exhaust pipe 112 extends from an outlet end of the water trap device and wraps over the top of the tunnels 40 to a discharge end. The discharge end desirably is located on the side of the chamber 94; however, the discharge end can be located at other positions on the watercraft hull 14.

The watercraft also includes a water cooling system and a bilge system which either supply water to the engine 96 or drain water from the engine compartment 28 using the jet propulsion units 64. The water cooling system includes a water tap 114 formed on the housing of one of the jet propulsion units 64 downstream of the associated impeller 68. The water inlet tap 114 thus receives pressurized water from the jet propulsion unit 64 and delivers the cooling water via a cooling water supply hose 116 to an engine water jacket and/or to a water jacket that extends along at least a portion of the exhaust system 110. At least some of the cooling water desirably is discharge with the exhaust gases for known silencing purposes.

The bilge system uses the reduced pressure formed upstream of the impeller 68 to suction water from the hull's bilge area. For this purpose, a drainage hose 118 extends between the bilge and a tap 120 formed on the other impeller housing 66 at a location upstream of the impeller 68.

As best seen in FIG. 6, both water taps 114, 120 are formed on the outer sides of the housings 66. The hoses 116, 118 also extends along the outer sides of the associated housing 66 and pass through the front wall 36 near the front comers of the pump chamber 34. As a result, space between the impeller housings 66 is not required to accommodate these taps 114, 120 and hoses 116, 118. The spacing between the jet propulsion units 64 therefore can generally match the spacing between the influent openings 48 of the intake ducts 42. Water resistance through the intake ducts 42 therefore is reduced while maintaining the desired position of the influent openings 48, close to the keel's center line (i.e., the watercraft central plane C).

In the illustrated embodiment, the crankshaft 106 constitutes an output shaft of the engine 96 and drives the impeller shafts 82; however, the engine 96 can include a drive mechanism that interconnects the crankshaft to an output shaft of the engine 106. Such a drive mechanism in some applications can reduce the rotational speed (i.e., step down the speed) of the output shaft relative to the crankshaft.

The output shaft 106 has an exposed rear portion which is coupled to an elastic coupling 122. The elastic coupling 122, in turn, transmits power to a short transmission input shaft 124 which extend rearwardly to a transmission 126.

The transmission 126 thus is interposed between the engine output shaft 106 and the jet propulsion units 64 for driving the two impeller shafts 82 of the jet propulsion units 64. As best seen in FIGS. 2–4, the transmission 126 includes an outer housing 128. The outer housing 128 is mounted on the front of the bulkhead 92 within the engine compartment 28. A plurality of fasteners 130 secure the housing 128 onto the bulkhead 92.

Vibration-damping rubber mounts 132 also support the transmission 126. The mounts 132 are positioned at the rear end of the engine compartment 28, next to the bulkhead 92, and sit beneath the transmission housing 128. In this manner, the mounts 132 support a portion of the weight to the transmission 126 without transmitting vibrations from the transmission housing 128 to the watercraft hull 14.

The transmission 126 includes a gear train or a tooth-belt system which transmits and splits the power from the input shaft 124 to two output shafts. The transmission 120 also causes a first of the output shafts to rotate in the same rotational direction as that of the input shaft 124 and a second of the output shaft to rotate in an opposite direction. In addition, the gear or pulley ratios can be such that the rotational speed of the input shaft 124 and the first and second output shafts are approximately equal or different (e.g., stepped-down).

That is, a speed reduction can be obtained, if needed, to permit higher engine speeds without causing cavitation. The first and second output shafts, however, desirably rotate at the same speed.

Each of the transmission output shafts have a respective end portion that extends behind the transmission and through the bulkhead 92. Each of the ends is formed with an internally splined opening that receives the externally splined end of a respective impeller shaft 82.

A protective tube 134 shrouds each of the impeller shafts 82. Each tube 134 includes an large front end which fits over the corresponding annular flange on the transmission housing 128 and cooperates with the respective threads to attach the tube 134 to the transmission housing 128.

The mounting arrangement of the present propulsion system improves the ease of assembly, as well as improves performance of the system. The propulsion unit adjustability provided by the mounting plate 56 permits the propulsion units 64 to be precisely aligned with the desired longitudinal axes y1, y2, as well as with each other. In addition, the rigidity provided by the mounting plate 56 tends to hold the propulsion units 64, which cantilever rearward from the unified plates 56, in the desired positions. As a result, additional support structure and fasteners can be removed from between the jet propulsion units and they can be spaced closer together so as to generally match a desired spacing between the influent openings 48 of the intake ducts 42. The described arrangement of the water supply and drainage holes 116, 118 also furthers this goal. Less resistance consequently occurs as the water flow into and through the intake ducts 42, thereby improving the efficiency of the jet propulsion units 64.

Figure 10:
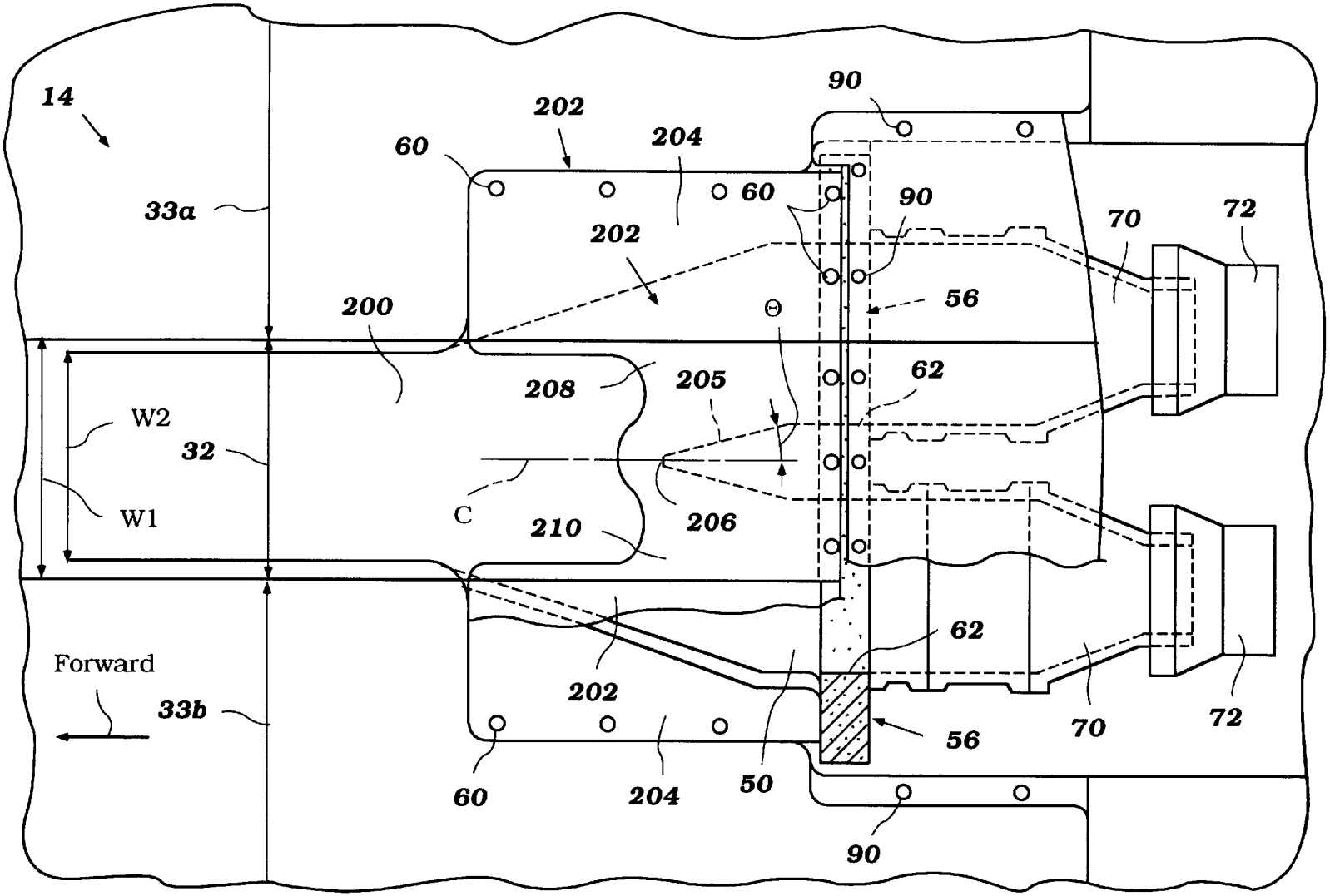
FIG. 10 is a partial sectional, bottom plan view of an inlet opening of a twin jet propulsion unit configured in accordance with another embodiment of the present invention.

FIG. 10 illustrated another embodiment of the propulsion system and its support structure. The illustrated twin jet propulsion is substantially similar to that described above, save the configured of the intake ducts, and thus the insert piece and the water inlet. Accordingly, like components between the two embodiments, which have a similar configuration and function to those described above, are designated by the same reference numerals. And the above description shall apply equally to these common components.

The propulsion system illustrated in FIG. 10 includes a single inlet or influent opening 200, which faces downward and which serves a water inlet duct 202 formed by a duct-forming insert piece 204. The inlet opening 200 desirably has a generally rectangular shape with a constant width W2 (as measured in a lateral direction normal to the axes of the impeller shafts 82); however, the inlet opening 200 can have any of a variety of shapes. The opening 200 though desirably is positioned centrally on the hull underside and on the flat keel 32. For this purpose, the opening 200 has a width W2 which is no larger than the width W1 of the keel.

The duct-forming portion 204 is provided in part with an internal wall 205 which has a curved forward end or leading edge 206 that divides a portion of the water inlet duct 202 into a pair of flow paths 208, 210. The leading edge 206 extends from a lower end point to an upper end point that lies in front of the lower end point such that the leading edge 206 of the wall 205 extends forward of the rear end of the opening 200 to assist in this separation. The lower end point of the wall 205 desirably is located at the rear end of the opening 200 so that the water flowing from the inlet opening 200 to the individual impellers 68 does not experience a significant change in direction. However, the wall 205 and particularly its upper end extends sufficiently forward so that the swirling motion generated to the inlet flow entering each impeller will not be transmitted to the other. In addition, the wall 205 tapers at a sufficient angle θ to provide adequate separation of the two paths 208, 210 far enough upstream of the impellers 68 that the upstream effects of the two impellers do not interfere with the efficiency of the jet propulsion units 64.

Although this invention has been described in terms of certain preferred embodiments, other embodiments apparent to those of ordinary skill in the art are also within the scope of this invention. Accordingly, the scope of the invention is intended to be defined only by the claims that follow.

What is claimed is:

1. A watercraft comprising a propulsion system including a pair of jet propulsion units and a pair of longitudinally extending intake ducts that communicate with said jet propulsion units, a hull including a pair of generally parallel tunnels formed on an underside thereof and integral therewith, each tunnel forming at least a portion of one of said intake ducts, and a mounting plate provided between said intake ducts and corresponding jet propulsion units, said mounting plate supported by the hull with said jet propulsion units mounted to said mounting plate, said mounting plate including openings which place the mounted jet propulsion units in communicationn with corresponding intake ducts.

2. A watercraft as in claim 1, wherein each intake duct includes a generally downward-facing influent opening.

3. A watercraft as in claim 1, wherein each intake duct includes a generally rearward-facing effluent opening.

4. A watercraft as in claim 1, wherein the intake ducts are located toward an aft end of the watercraft.

5. A watercraft as in claim 1, wherein each of said openings of said mounting plate generally matches the cross-sectional shape and size of the juxtaposed corresponding openings of the respective intake duct and the jet propulsion unit.

6. A watercraft as in claim 1, wherein an effluent opening of one of the intake ducts and an influent opening of the corresponding jet propulsion unit are both concentrically positioned about a common axis.

7. A watercraft as in claim 6 additionally comprising an impeller shaft, said jet propulsion unit comprising a housing and an impeller positioned within said housing, said impeller shaft rotating about said common axis and driving said impeller.

8. A watercraft as in claim 1, additionally comprising a ride plate removably fixed to the underside of the hull and covering the jet propulsion units, said ride plate being supported, at least in part, by said mounting plate.

9. A watercraft as in claim 1, wherein the hull additionally comprises a cavity formed behind the tunnels, the cavity being defined in part by a front wall through which the tunnels open in a rearward direction, and the mounting plate is supported by the front wall of the hull cavity.

10. A watercraft as in claim 9, wherein said mounting plate is adjustable relative to the front wall of the hull cavity.

11. A watercraft as in claim 1 additionally comprising an engine driving said jet propulsion units, said engine being coupled to impeller shafts of the jet propulsion units through a transmission, said transmission being supported on a generally upstanding wall spaced forward of said mounting plate.

12. A watercraft as in claim 11, wherein a damper positioned on a lower section of the hull supports at least a portion of the transmission.

13. A watercraft as in claim 1 additionally comprising a pair of fluid lines coupled to the propulsion system, one of said fluid lines being located on one side of the jet propulsion units, and the other of said fluid lines being located on the other side of the jet propulsion units.

14. A watercraft as in claim 13, wherein each jet propulsion unit comprises a housing and an impeller rotatably positioned within said housing, and one of said fluid lines is a cooling water supply hose that extends between a water jacket of an internal combustion engine, which drives the jet propulsion units, and a water tap, which is located on the housing of one of the jet propulsion units downstream of said impeller.

15. A watercraft as in claim 13, wherein each jet propulsion unit comprises a housing and an impeller rotatable positioned within said housing, and one of the fluid lines is a drain hose that extends from a bilge area within the hull to a water tap located on the housing of one of the jet propulsion units upstream of the impeller therein.

16. A watercraft as in claim 1, wherein the hull comprises a keel having a generally flat horizontally extending central section located near the aft end of the watercraft, the flat central section of the keel being defined between a pair of edges, and each of the intake duct includes an inlet opening with an inner edge proximate to the center line of the watercraft, the inner edges of the inlet openings being located between the edges of the keel.

17. A watercraft as in claim 16, wherein the hull includes a pair of upwardly inclined surfaces which extend from the keel edges, and a portion of each intake duct opening is formed on a respective one of said upwardly inclined surfaces.

18. A watercraft as in claim 17, wherein said jet propulsion units comprise a port side impeller and a starboard side impeller and the impellers of the jet propulsion units rotate in opposite directions from each other, said port side impeller of said jet propulsion units rotating in a counterclockwise direction, as viewed from an aft end of the watercraft, and said starboard side impeller rotating in a clockwise direction, as viewed from the aft end of the watercraft.

19. A watercraft comprising a hull of generally unitary construction and defining at least one tunnel on an underside of the hull, the tunnel being configured to form at least a portion of an intake duct, at least one jet propulsion unit positioned behind the intake duct, and a mounting plate provided between the intake duct and the jet propulsion unit, the mounting plate being supported by the hull with the jet propulsion unit being fastened to the mounting plate, the mounting plate including an opening through which the jet propulsion unit communicates with the intake duct.

20. A watercraft as in claim 19, wherein the hull includes a cavity formed on its underside behind the tunnel, and the cavity is defined in part by a front wall through which the tunnel opens into the cavity and to which the mounting plate is secured.

21. A watercraft as in claim 20 additionally comprising a ride plate extending below an impeller housing of the jet propulsion unit across the cavity, said ride plate being removably fixed to the mounting plate.

22. A watercraft as in claim 19, wherein a duct plate closes a lower side of the tunnel to form at least a lower wall of the inlet duct, and the duct plate is removably fixed to the hull.

23. A watercraft as in claim 22, wherein the duct plate is also removably fixed to the mounting plate.

24. A watercraft as in claim 1, further comprising a lower plate, said lower plate closing a portion of a lower side of said tunnels and wherein said intake ducts comprise inlet openings, said lower plate forming a portion of said inlet openings with said inlet openings formed forward of at least a portion of said lower plate.

25. A watercraft as in claim 24, wherein said lower plate is removably fixed to the underside of the hull by fasteners.

26. A watercraft as in claim 24, wherein said lower plate is removably fixed to said mounting plate.

27. A watercraft as in claim 24, wherein said lower plate is a single unit.

28. A watercraft comprising a propulsion system including a pair of jet propulsion units and a pair of longitudinally extending intake ducts that communicate with the jet propulsion units, a hull including a pair of generally parallel tunnels formed on an underside thereof and integral therewith, each tunnel forming at least a portion of one of the intake ducts, the hull further including a keel having a generally flat horizontally extending central section located near an aft end of the watercraft, the flat central section of the keel being defined by a pair of edges, and each of the intake ducts including an inlet opening with an inner edge proximate to the center line of the watercraft, the inlet openings being located on opposite sides of the center line with each inlet opening arranged entirely to a side of the center line, and being arranged with the inner edges of the inlet openings positioned between the edges of the flat central section of the keel.

29. A watercraft comprising a propulsion system including a pair of jet propulsion units and a pair of longitudinally extending intake ducts that communicate with the jet propulsion units, a hull including a pair of generally parallel tunnels formed on an underside thereof and integral therewith, each tunnel forming at least a portion of one of the intake ducts, the hull further including a keel having a generally flat horizontally extending central section located near an aft end of the watercraft, the flat central section of the keel being defined by a pair of edges, a pair of upwardly inclined surfaces extending from the edges, each of the intake ducts including an inlet opening with an inner edge proximate to the center line of the watercraft, the inner edges of the inlet openings being located between the edges of the flat central section of the keel, and a portion of each inlet opening being located on a respective one of the upwardly inclined surfaces.

* * * * *

UNITED STATES PATENT AND TRADEMARK OFFICE
CERTIFICATE OF CORRECTION

PATENT NO. : 6,022,250

DATED : February 8, 2000

INVENTOR(S): Futaki et al.

It is certified that error appears in the above-identified patent and that said Letters Patent is hereby corrected as shown below:

In Claim 1, column 10, line 33, "communicationn" should be --communication--.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*